US009114305B2

(12) United States Patent
Keffler

(10) Patent No.: US 9,114,305 B2
(45) Date of Patent: Aug. 25, 2015

(54) FULL AUTO SPLITBOARD BINDING

(71) Applicant: John William Keffler, Evergreen, CO (US)

(72) Inventor: John William Keffler, Evergreen, CO (US)

( * ) Notice: Subject to any disclaimer, the term of this patent is extended or adjusted under 35 U.S.C. 154(b) by 0 days.

(21) Appl. No.: 14/025,764

(22) Filed: Sep. 12, 2013

(65) Prior Publication Data

US 2014/0091557 A1 Apr. 3, 2014

Related U.S. Application Data

(60) Provisional application No. 61/701,626, filed on Sep. 15, 2012.

(51) Int. Cl.

| | |
|---|---|
| ***B63C 5/02*** | (2006.01) |
| ***A63C 5/02*** | (2006.01) |
| ***A63C 9/00*** | (2012.01) |
| ***A63C 10/00*** | (2012.01) |
| ***A63C 5/03*** | (2006.01) |
| ***A63C 10/14*** | (2012.01) |

(52) U.S. Cl.

CPC . *A63C 5/02* (2013.01); *A63C 5/031* (2013.01); *A63C 9/00* (2013.01); *A63C 10/00* (2013.01); *A63C 10/145* (2013.01)

(58) Field of Classification Search

CPC ..... A63C 5/02; A63C 9/0807; A63C 9/081; A63C 9/082; A63C 9/084; A63C 9/085; A63C 9/08507; A63C 9/08535; A63C 9/0855

USPC ..... 280/611, 613, 614, 617, 618, 623, 624, 280/603

See application file for complete search history.

(56) References Cited

U.S. PATENT DOCUMENTS

| | | | | |
|---|---|---|---|---|
| 5,649,722 | A | 7/1997 | Champlin | |
| 5,971,419 | A | 10/1999 | Knapschafer | |
| 5,984,324 | A | 11/1999 | Wariakois | |
| 6,523,851 | B1 | 2/2003 | Maravetz | |
| 8,033,564 | B2 * | 10/2011 | Riepler et al. | 280/603 |
| 8,226,109 | B2 | 7/2012 | Ritter | |
| 8,469,372 | B2 * | 6/2013 | Kloster et al. | 280/14.22 |
| 8,733,783 | B2 | 5/2014 | Kloster et al. | |
| 8,764,043 | B2 | 7/2014 | Neubauer et al. | |
| 2012/0274036 | A1 | 11/2012 | Kloster et al. | |
| 2014/0210187 | A1 | 7/2014 | Ritter | |
| 2014/0232087 | A1 | 8/2014 | Bulan | |

FOREIGN PATENT DOCUMENTS

WO WO 2014/007658 1/2014

OTHER PUBLICATIONS

Ranger Splitboard Bindings, http://rangerbindings.com/; Retrieved: Jan. 21, 2015.

Plum Splitboard, "Feyan Carbon", http://www.fixation-plum.com/en/products-page/splitboard/feyan-carbon/; Retrieved Jan. 21, 2015.

Split Stick Ride Infini, http://www.splitsticks.com/; Retrieved Jan. 21, 2015.

* cited by examiner

*Primary Examiner* — John Walters

(74) *Attorney, Agent, or Firm* — Lathrop & Gage LLP

(57) ABSTRACT

A splitboard binding was developed specifically for boots that have toe and heel landings for full auto binding bails. The binding is also designed to interface with splitboard and solid snowboard bolt patterns. The basic components of the design can be broken up into two pieces, the parts that stay with the splitboard at all times, and the parts that are removable, only to be used when the splitboard is being ridden as a snowboard. The basic design of the mechanism is a twist lock motion with two tabs that secure the binding in place.

19 Claims, 3 Drawing Sheets

FULL AUTO SPLITBOARD BINDING

CROSS-REFERENCE TO RELATED APPLICATIONS

Provisional Application No. 61/701,626, filed on Sep. 15, 2012.

BACKGROUND OF THE INVENTION

Back country snowboarding is for those that want to ride a snowboard where there are not lifts. Most snowboarders start riding the back country by carrying their snowboard on their backs and hike in snowshoes. In recent years, a snowboard that is "split" down the middle so it can separate to form two separate ski like parts has become the norm for back country snowboarding. Each half of the board can be fitted with skins to aid in traction for uphill cross-country travel. Once at the top, the two half are then put together to form a snowboard.

Typically snowboarders use a boot that has a fabric shell with a foam liner. Snowboarders like the softer feel and ride that this boot provides, but there are draw back to using a boot like this in the back country. Soft boots are more susceptible to absorbing water, which makes them harder to dry when spending days in the winter wilderness. They break down quickly and the fit changes quickly with use. They are typically designed just for the descent and are too ridged at the ankles for long hikes. When boot crampons are needed, the crampons are difficult to keep in place. When hiking up on firm snow, kicking in steps becomes difficult.

Skiers made the switch to a plastic shell boot years ago. For skiers, the plastic boot is critical for transferring power to the skis and providing a solid connection to the skis. These boots have landings at the heel and toe for interfacing with ski bindings and are also used for boot crampon attachment points. A plastic shell boot is not susceptible to water absorption like soft shell boots, they perform well when kicking in steps and provide a consistence fit for an extended period of usage. However, most ski boots are heavy, too stiff for snowboarding and not designed to flex. In very recent years, ski boot manufactures have begun to make a boot designed specifically for those who want a lightweight boot that articulates when hiking for a more efficient stride but locks out for ski descents. These backcountry specific ski boots have a few draw backs for skiers. They are typically too soft and flex too much when compared to a typical downhill ski boots. However these boots have become boots that are easy to modify for back country snowboarding with one exception, splitboard binding that is specially designed just for these types of boots.

BRIEF SUMMARY OF THE INVENTION

Disclosed here are splitboard bindings designed specifically for plastic shell boots with toe and heel landings along with pivot points at the toe for attachment points for cross-country hiking. The bindings are designed such that the boot and bindings flex to provide an overall feel that snowboarders are used to. The bindings are designed to put the boot as close to the board as possible and provide additional support across the splitboard board halves which improves the rigidity of the splitboard and makes it feel much more like a traditional one piece snowboard.

The bindings are designed to stow when the board is separated and used as cross country skies. Existing ski toe bindings are used to attach the boot to the board halves when cross country skiing. This provides an advantage for long hikes as it reduces the swing weight at the feet.

When the board halves are connected to form a snowboard, the bindings that where stowed for cross country travel are exhumed and twist onto the board cleats mounted to the board halves and lock in place with locking pins imbedded in the binding plate assembly.

DETAILED DESCRIPTION OF THE INVENTION

Figure 1:
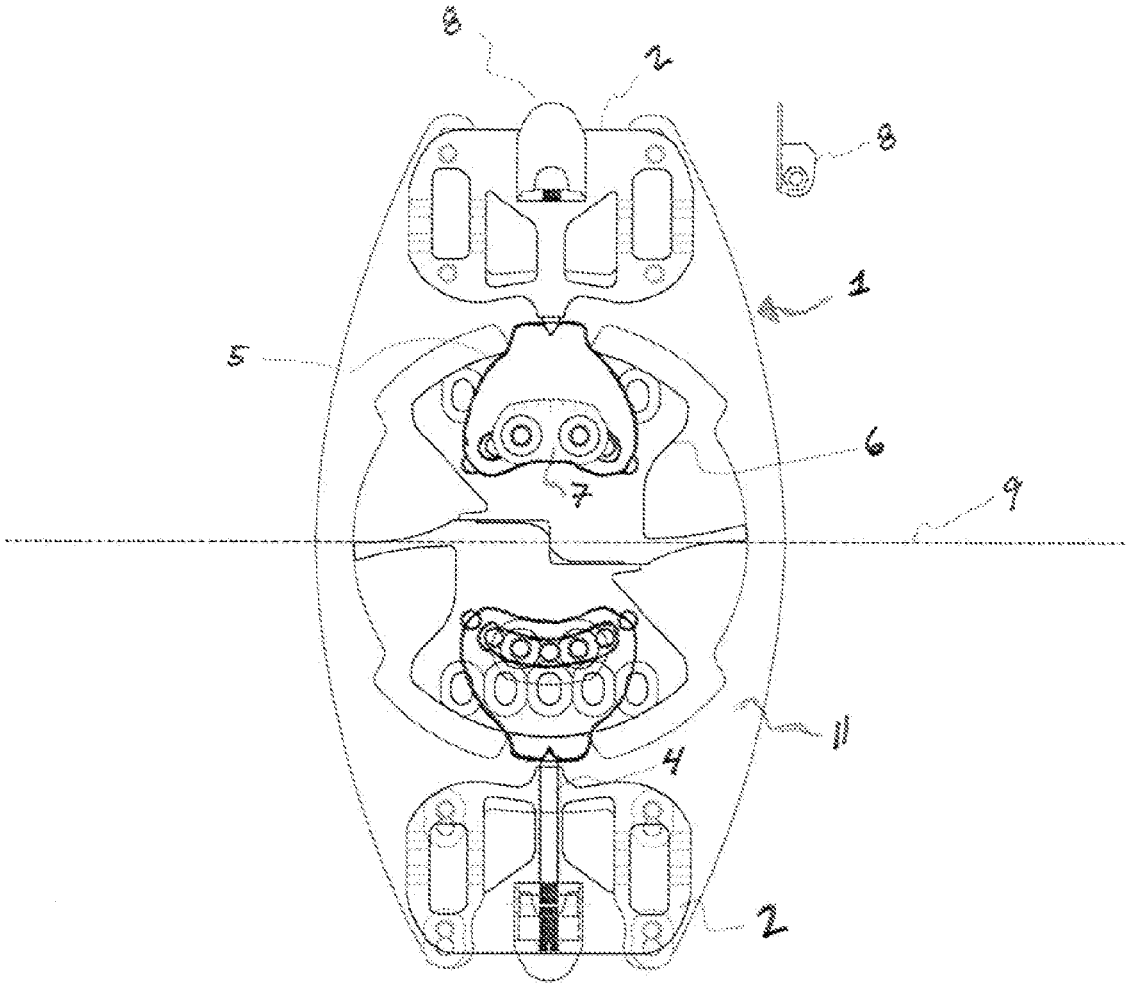
FIG. 1 is a plan view of the binding as it would be assembled for ride mode.

FIG. 1 illustrates the binding as it would be assembled for ride mode. The binding plate assembly 1 is comprised of the one binding plate 11, the two bail blocks 2, the locking pin system 3 and the bails (not shown). To remove the binding plate assembly 1, the lever 8 is actuated in the open position and the pin 4 retracts. When this is done for both sides, the binding plate assembly can rotate in either direction and will then detach once the lower tab on the binding plate 11 is clear of the locking tab 5, which is disposed between a top washer 7 and a board plate 6, which has a portion that extends over a centerline 9 of the splitboard. Also shown on this figure is the side profile of the lever 8.

When the binding is positioned as seen in FIG. 1, the boot sole rests on the top of the bail blocks 2 and the levers 8 are not able to be actuated. This ensures that the locking pins 4 cannot retract while riding.

Figure 2:
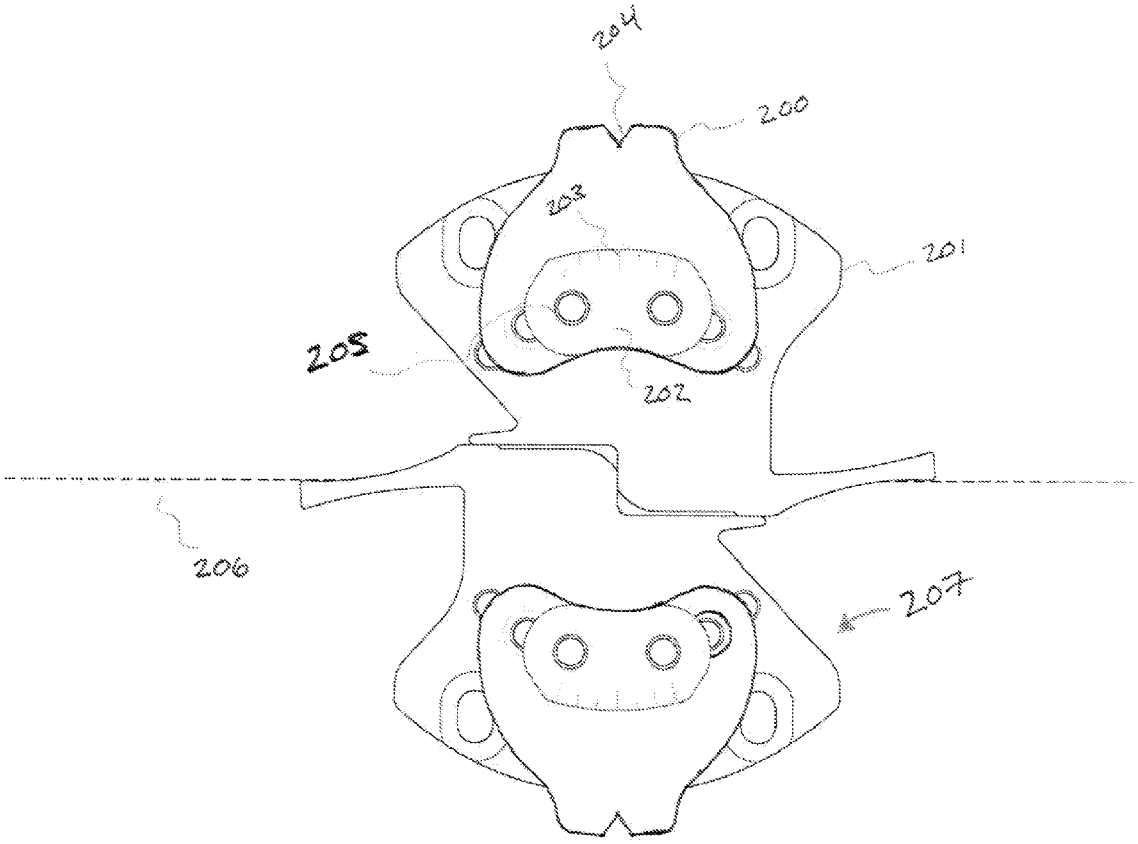
FIG. 2 is a plan view of just the board cleats as mounted and the board halves mated for ride mode.

FIG. 2 illustrates the board cleat assembly 207 as it would be assembled for ride mode and the binding plate assembly not attached. The splitboard centerline 206 is horizontal to the view. The board cleat assembly 207 is comprised of the locking tab 200, the board plate 201 and the top washer 202. The locking tab 200 is adjustable in +/−15 degree increments for each position and can be repositioned to achieve greater angles. Machine screws mount through the holes 205 on the top washer 202 and thread into the underlying board plate 201. The V-slot 204 in the locking tab 200 is the receiving surface for the locking pin when the binding plate assembly is attached and secured.

Figure 3:
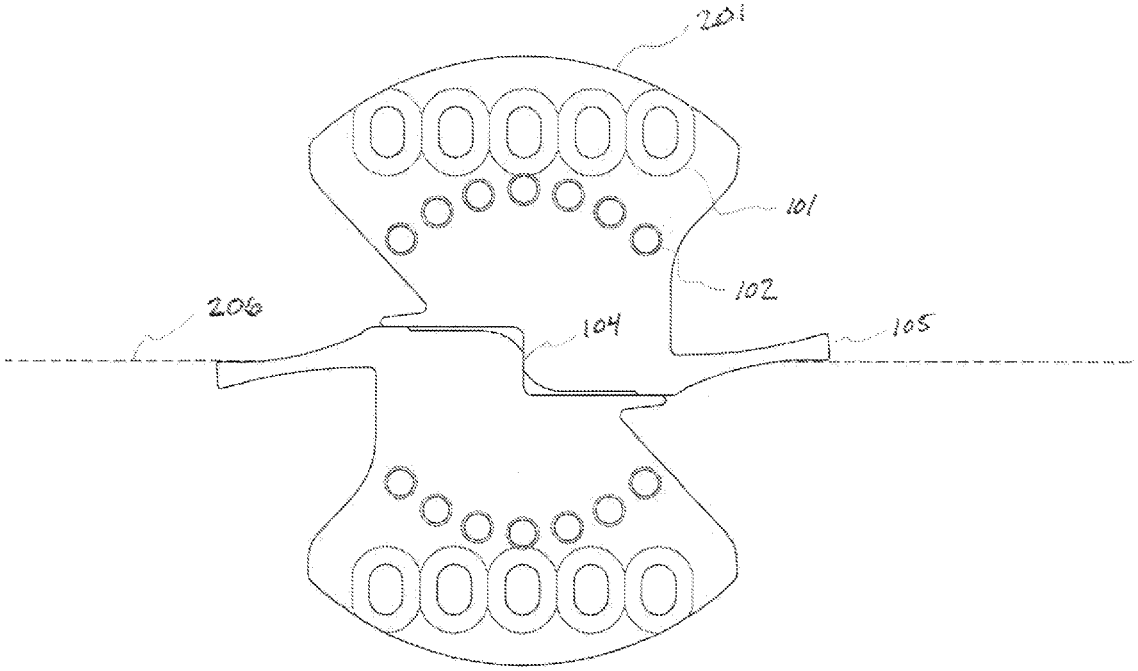
FIG. 3 is a plan view of just the board plates as mounted and the board halves mated for ride mode.

FIG. 3 illustrates the board plates 100 as it would be assembled for ride mode with the splitboard halves mated. The splitboard centerline 206 is horizontal to the view. The first step to assembling the binding is to mount the board plates 201 to the splitboard. The machined slots 101 on the board plates 201 are spaced apart to provide rider stance width adjustability. Once the board plates 201 are secured to the board, the other components shown in FIG. 2 can be mounted. Each of the two board plates 201 are mounted to each half of the splitboard. When the splitboard halves are mated together, part of the board plates 201 overlap each half of the board. This is by design and creates a more ridged board feel. The board plates 201 have two stops to aid in the alignment of the two board halves. Once the board halves are aligned, the board halves cannot slide past each other because of the stop 104. However, the board can slide back apart unless the binding plate assembly is mounted and then the binding plate assembly interfaces with the other stops 105. The board plate 201 has threaded holes 102 for the machine screws that hold the locking tab to the board plate 201. Only two of the seven threaded holes are used at any one time. To achieve different foot angles, various threaded holes can be used.

Various manufacture techniques can be employed to make each of the various components. The component shown in FIG. 1 are typically laser cut from a flat sheet of aluminum or stainless steel and then countersinks, slots and other machining operations are performed.

The invention claimed is:

1. A binding for use on a splitboard, the binding comprising:

a pair of board plates, wherein each board plate is configured to be fixedly mounted to a half of the splitboard such that a portion of each board plate extends over a centerline of the splitboard;

a pair of locking tabs, wherein each locking tab is configured to be mounted on one of the board plates and to extend over a distal edge thereof; and a binding plate comprising an opening for receiving the pair of board plates, wherein a portion of the binding plate is configured to slide under the locking tab.

2. The binding of claim 1, wherein, in ride mode, each board plate overlaps both halves of the splitboard to increase rigidity of the splitboard.

3. The binding of claim 1, wherein the board plates comprise mating features.

4. The binding of claim 1 further comprising at least one retractable pin configured to join with one of the locking tabs.

5. The binding of claim 4, further comprising a pair of retractable pins diametrically opposed to one another and configured to join with the pair of locking tabs.

6. The binding of claim 4, further comprising a pair of retractable pins disposed at a toe portion and a heel portion of the binding plate, wherein the retractable pins are diametrically opposed to one another and configured to join with the pair of locking tabs.

7. The binding of claim 1, wherein each of the board plates comprises a stop for interfacing with the binding plate.

8. The binding of claim 1, wherein the locking tabs and the binding plate are adjustable relative to a fixed position of the board plates.

9. The binding of claim 8, wherein the locking tabs and the binding plate are adjustable in 15 degree increments relative to the fixed position of the board plates.

10. A binding for use on a splitboard, the binding comprising:

a pair of board cleats, wherein each board cleat is configured to be fixedly mounted to a half of the splitboard such that a portion of each board cleat extends over a centerline of the splitboard; and a binding plate comprising an opening for receiving the pair of board cleats, wherein at least a portion of the binding plate is configured to slide under at least one board cleat.

11. The binding of claim 10, wherein, in ride mode, each board cleat overlaps both halves of the splitboard to increase rigidity of the splitboard.

12. The binding of claim 10, wherein the board cleats comprise mating features.

13. The binding of claim 10 further comprising at least one retractable pin configured to join with one of the board cleats.

14. The binding of claim 13, further comprising a pair of retractable pins diametrically opposed to one another and configured to join with the pair of board cleats.

15. The binding of claim 13, further comprising a pair of retractable pins disposed at a toe portion and a heel portion of the binding plate, wherein the retractable pins are diametrically opposed to one another and configured to join with the pair of board cleats.

16. The binding of claim 10, wherein each of the board cleats comprises a stop for interfacing with the binding plate.

17. The binding of claim 10, wherein each board cleat comprises a locking tab configured to be mounted on a board plate and to extend over a distal edge thereof.

18. The binding of claim 17, wherein the locking tabs and the binding plate are adjustable relative to a fixed position of the board plates.

19. The binding of claim 17, wherein the locking tabs and the binding plate are adjustable in 15 degree increments relative to the fixed position of the board plates.

* * * * *